US009758981B2

(12) United States Patent
Charles et al.

(10) Patent No.: US 9,758,981 B2
(45) Date of Patent: Sep. 12, 2017

(54) STAIR EXPANSION JOINT SYSTEM WITH FREEDOM OF MOVEMENT BETWEEN LANDINGS

(71) Applicant: EMEH, Inc., Lebanon, NJ (US)

(72) Inventors: Bryan I. Charles, Muncy, PA (US); Roger W. Barr, Williamsport, PA (US); Kevin W. Smith, Hughesville, PA (US); Anthony J. Peachey, Muncy, PA (US); Timothy A. Fisher, Montoursville, PA (US); Harold Dale Mathias, Watsontown, PA (US); Justin Eugene Moon, Montgomery, PA (US); Gabriel Patrick Blasi, Montgomery, PA (US)

(73) Assignee: EMEH, INC., Lebanon, NJ (US)

( * ) Notice: Subject to any disclaimer, the term of this patent is extended or adjusted under 35 U.S.C. 154(b) by 0 days.

(21) Appl. No.: 15/078,378

(22) Filed: Mar. 23, 2016

(65) Prior Publication Data

US 2016/0215496 A1 Jul. 28, 2016

Related U.S. Application Data

(63) Continuation-in-part of application No. 14/513,354, filed on Oct. 14, 2014.

(51) Int. Cl.
*E04F 11/00* (2006.01)
*E04F 19/10* (2006.01)
(Continued)

(52) U.S. Cl.
CPC ..... *E04H 9/02* (2013.01); *E04B 1/36* (2013.01); *E04F 11/022* (2013.01)

(58) Field of Classification Search
CPC . E04F 2011/0203; E04F 11/022; E04F 11/04; E04B 1/36; E04H 9/021; E04H 9/02
(Continued)

(56) References Cited

U.S. PATENT DOCUMENTS 1,419,834 A 6/1922 Fellows
3,068,958 A * 12/1962 McCann ..... E04F 11/04 182/89
(Continued)

FOREIGN PATENT DOCUMENTS

GB 976069 A 11/1964
GB 2043801 A 10/1980

OTHER PUBLICATIONS

U.S. Appl. No. 14/513,354, Jan. 16, 2017 Reply Brief Filed.
(Continued)

*Primary Examiner* — Brian Mattei
(74) *Attorney, Agent, or Firm* — Baker Botts L.L.P.

(57) ABSTRACT

A stair system with freedom of movement between landings associated therewith includes a connection system configured to connect stairs to a landing associated with a construction, wherein the connection system structurally supports the stairs for safe egress over the stairs while concurrently supporting movement between the landing and a second landing associated with the construction by the stairs in at least one dimension, and wherein the movement supports inter-story drift between the landing and the second landing and removes some force translation between the landing and the second landing.

18 Claims, 10 Drawing Sheets

(51) Int. Cl.
*E04H 9/02* (2006.01)
*E04F 11/022* (2006.01)
*E04B 1/36* (2006.01)

(58) Field of Classification Search
USPC ..... 52/183
See application file for complete search history.

(56) References Cited

U.S. PATENT DOCUMENTS 3,590,851 A * 7/1971 Bogossian ..... F16K 15/20 137/223
3,805,464 A 4/1974 Hanson
4,238,137 A 12/1980 Furchak et al.
4,642,953 A 2/1987 DeGood
4,707,957 A * 11/1987 Shepherd ..... E04F 11/06 182/115
5,887,540 A * 3/1999 Krish, Jr. ..... B60R 3/005 114/362
5,941,342 A * 8/1999 Lee ..... B60R 3/02 182/127
8,640,826 B1 * 2/2014 Beilstein ..... E06C 5/02 114/362
2005/0211502 A1 * 9/2005 LaBrash ..... E06C 5/04 182/127
2008/0236065 A1 10/2008 Conservano
2009/0300994 A1 * 12/2009 Atkins, III ..... E04H 3/28 52/7
2010/0117312 A1 5/2010 Walkingshaw et al.
2010/0293875 A1 11/2010 Preston
2016/0102461 A1 4/2016 Charles et al.

OTHER PUBLICATIONS

U.S. Appl. No. 14/513,354, Oct. 4, 2016 Appeal Brief Filed.
U.S. Appl. No. 14/513,354, Aug. 4, 2016 Notice of Appeal Filed.
U.S. Appl. No. 14/513,354, Jun. 6, 2016 Final Office Action.
U.S. Appl. No. 14/513,354, May 9, 2016 Response to Non-Final Office Action.
U.S. Appl. No.14/513,354, Feb. 8, 2016 Non-Final Office Action.
U.S. Appl. No. 14/513,354, Jan. 15, 2016 Amendment and Request for Continued Examination (RCE).
U.S. Appl. No. 14/513,354, Nov. 20, 2015 Response after Final Office Action.
U.S. Appl. No. 14/513,354, Sep. 21, 2015 Final Office Action.
U.S. Appl. No. 14/513,354, Aug. 21, 2015 Response to Non-Final Office Action.
U.S. Appl. No. 14/513,354, May 21, 2015 Non-Final Office Action.
U.S. Appl. No. 14/513,354, Apr. 27, 2015 Response to Restriction Requirement.
U.S. Appl. No. 14/513,354, Mar. 6, 2015 Restriction Requirement.

* cited by examiner

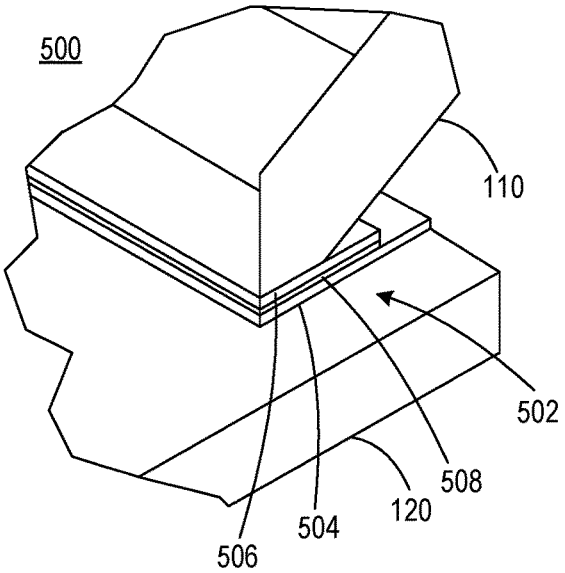
FIG. 16
FIG. 15
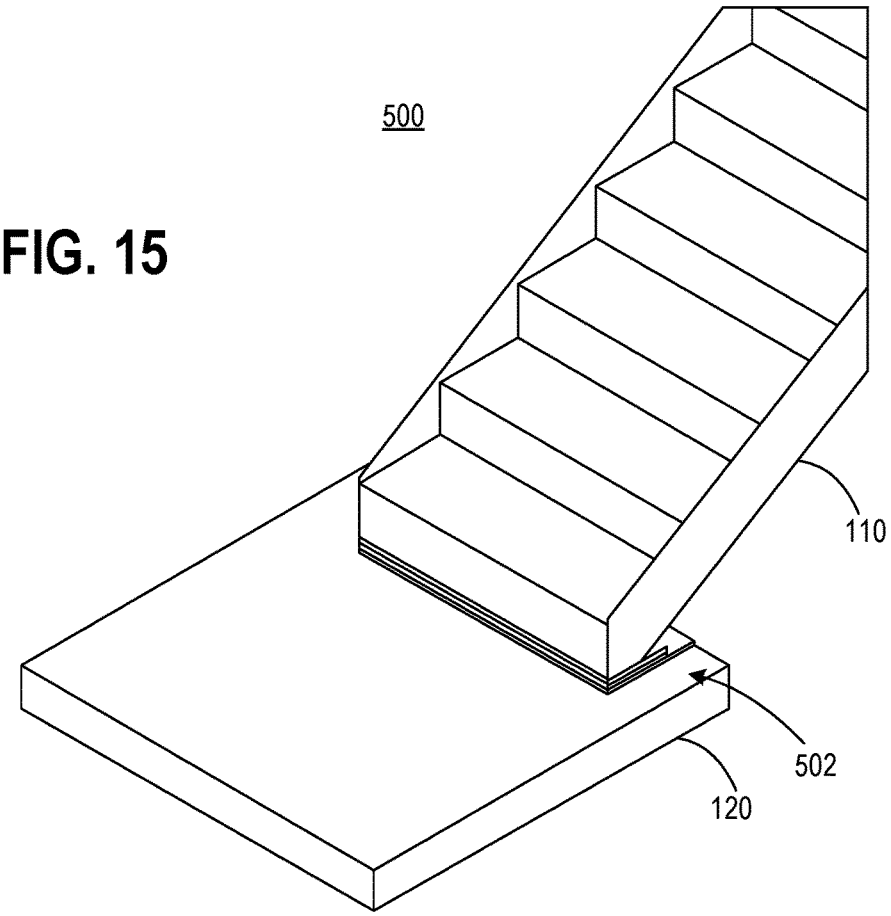

STAIR EXPANSION JOINT SYSTEM WITH FREEDOM OF MOVEMENT BETWEEN LANDINGS

CROSS-REFERENCE TO RELATED APPLICATION(S)

The present patent/application is a continuation-in-part of U.S. patent application Ser. No. 14/513,354, filed Oct. 14, 2014, and entitled "STAIR EXPANSION JOINT SYSTEM WITH FREEDOM OF MOVEMENT BETWEEN LANDINGS," the contents of which are incorporated by reference herein.

FIELD OF THE DISCLOSURE

The present disclosure relates generally to stairs and associated joint system connections. More particularly, the present disclosure relates to a stair expansion joint system with freedom of movement between landings.

BACKGROUND OF THE DISCLOSURE

Conventionally, installing stairs creates a rigid structure between landings or levels as the stairs are a rigid diagonal member that creates force between the levels. The force created by this rigid diagonal member must be accounted for in building design. Also, because of inter-story drift during seismic events, the rigid diagonal member created by the stairs causes damage to the surrounding structure and/or the stairs. Damage could result in structural damage and/or total collapse of the stairs eliminating a means of egress from the building during or after an event. In particular, based on review of various earthquakes and associated building failures based thereon, it has been determined the most likely failure point for stairs the connections between the stairs and the landing. Thus, it would be advantageous for a stair expansion joint system with freedom of movement between landings that addresses the most likely failure point, namely the stair to landing connections.

BRIEF SUMMARY OF THE DISCLOSURE

In an exemplary embodiment, a stair expansion joint system enabling freedom of movement between stairs and a landing includes a latch system associated with the stairs; and a catch system associated with the landing, wherein the catch system includes a rod adapted to connect to the latch system and one or more spring components adapted to connect the catch system to the landing, the rod connected to the latch system and the one or more spring components connected to the landing collectively provide the freedom of movement between the stairs and the landing. The latch system can include a landing plate and a stair mount including a lip structure adapted to engage the rod, and wherein the catch system can include a lateral slide connected to a base mount, wherein the rod is disposed to a flange structure on the lateral slide and the one or more spring components connect the lateral slide to the landing. The landing plate can be connected to the stair mount via a hinge enabling the landing plate to rotate about the stair mount, providing access to the latch system and the catch system from the landing. The base mount can be fixed to a beam associated with the landing and the lateral slide is connected to the beam via the one or more spring components. The lateral slide can slidingly engage a channel in the base mount. The stair mount can be one of connected to and integrally formed in a top of the stairs. The rod can include an acetal homopolymer resin.

In another exemplary embodiment, a stair expansion joint method enabling freedom of movement between stairs and a landing includes providing a latch system associated with the stairs; and providing a catch system associated with the landing, wherein the catch system includes a rod adapted to connect to the latch system and one or more spring components adapted to connect the catch system to the landing, the rod connected to the latch system and the one or more spring components connected to the landing collectively provide the freedom of movement between the stairs and the landing.

In a further exemplary embodiment, a stair system with freedom of movement between the stairs and associated landings includes stairs including a latch system at a top of the stairs, wherein the latch system includes a landing plate and a stair mount including a lip structure adapted to engage the rod; and a structure associated with a landing including a catch system, wherein the catch system includes a lateral slide connected to a base mount, wherein a rod is disposed to a flange structure on the lateral slide and one or more spring components connect the lateral slide to the landing, wherein the rod connected to the latch system and the one or more spring components connected to the landing collectively provide the freedom of movement between the stairs and the landing. The stair system can further include a connection system between a bottom of the stairs and a lower landing.

In an exemplary embodiment, a stair system with freedom of movement between landings associated therewith includes a connection system configured to connect stairs to a landing associated with a construction, wherein the connection system structurally supports the stairs for safe egress over the stairs while concurrently supporting movement between the landing and a second landing associated with the construction by the stairs in at least one dimension, and wherein the movement supports inter-story drift between the landing and the second landing and removes some force translation between the landing and the second landing. The landing can be a lower landing and the second landing can be an upper landing. The stair system can further include a second connection system configured to connect the stairs to the second landing, wherein the second connection system structurally supports the stairs for safe egress over the stairs while concurrently supporting movement between the landing and the second landing associated with the construction by the stairs in at least one dimension. The landing can be an upper landing and the second landing can be a lower landing.

The connection system can include at least two base isolators connected to the stairs and supported by the landing, wherein each of the at least two base isolators include a first bearing pad connected to the stairs, a second bearing pad support by the landing, and a flexible member between the first bearing pad and the second bearing pad. The flexible member can be an isolator spring or a rubber isolator, and wherein the at least two base isolators provide movement of the stairs in multiple directions relative to the landing. The connection system can include a hinged lateral slide mechanism between the stairs and the landing, the landing is an upper landing, wherein the hinged lateral slide mechanism prevents the stairs from rigid attachment to the upper landing. The hinged lateral slide mechanism can include a stair mount on the stairs coupled to a lateral slide on the upper landing via a connector; and a base mount fixed to the upper landing or an associated structure, wherein the base mount supports the lateral slide, and wherein the lateral slide is moveable relative to the upper landing or the associated structure and the stair mount is moveable relative to the lateral slide via the connector.

The connection system can include a precast stair slide system supported by a structure associated with the landing; and a tether system configured to connect a landing portion of the precast stair slide system to the landing in a moveable manner. The precast stair slide system can further include a plurality of bearing pads between the landing portion and the structure associated with the landing. The connection system can include a roller isolated assembly with a ball bearing base surface connected to the landing, a ball bearing support surface connected to the stairs, and a ball bearing between the ball bearing base surface and the ball bearing support surface, wherein the stairs are moveable relative to the landing about the ball bearing.

The connection system can include a sliding base assembly with a first plate connected to the stairs, a second plate connected to the landing, and a third plate between the first plate and the second plate, wherein the stairs are moveable relative to the landing based on the third plate. The first plate and the third plate can be high-density polyethylene and the second plate is metal. The connection system can include a stair pin system with a plurality of pistons connected to the landing and connected to the stairs via arms, wherein the stairs are moveable in one dimension based on movement of the pistons. The connection system can include a suspended stair assembly with attachments to a structure associated with the landing, the landing is an upper landing, and tethers to the stairs from the attachments, wherein the stairs are not fixedly attached to a lower landing.

In another exemplary embodiment, stairs with freedom of movement between landings associated therewith include a plurality of treads and rises; a support structure disposed to the plurality of treads and rises; an upper connector configured to support an upper portion of the support structure at an upper landing; and a lower connector configured to support a lower portion of the support structure at a lower landing; wherein at least one of the upper connector and the lower connector structurally supports the support structure for safe egress over the plurality of treads and rises while concurrently supporting movement between the landings by the support structure in at least one dimension, and wherein the movement supports inter-story drift between the landings and removes some force translation between the landings. The support structure can be fixedly connected to the upper landing and moveably connected to the lower landing. The support structure can be moveably connected to the upper landing and moveably connected to the lower landing. The support structure can be moveably connected to the upper landing and fixedly connected to the lower landing.

BRIEF DESCRIPTION OF THE DRAWINGS

The present disclosure is illustrated and described herein with reference to the various drawings, in which like reference numbers are used to denote like system components/method steps, as appropriate, and in which:

FIG. 15 is a perspective diagram of a sliding base stair system in an exemplary embodiment;

FIG. 16 is a magnified perspective diagram of a sliding base assembly in the sliding base stair system of FIG. 15 in an exemplary embodiment;

DETAILED DESCRIPTION OF THE DISCLOSURE

Figure 1:
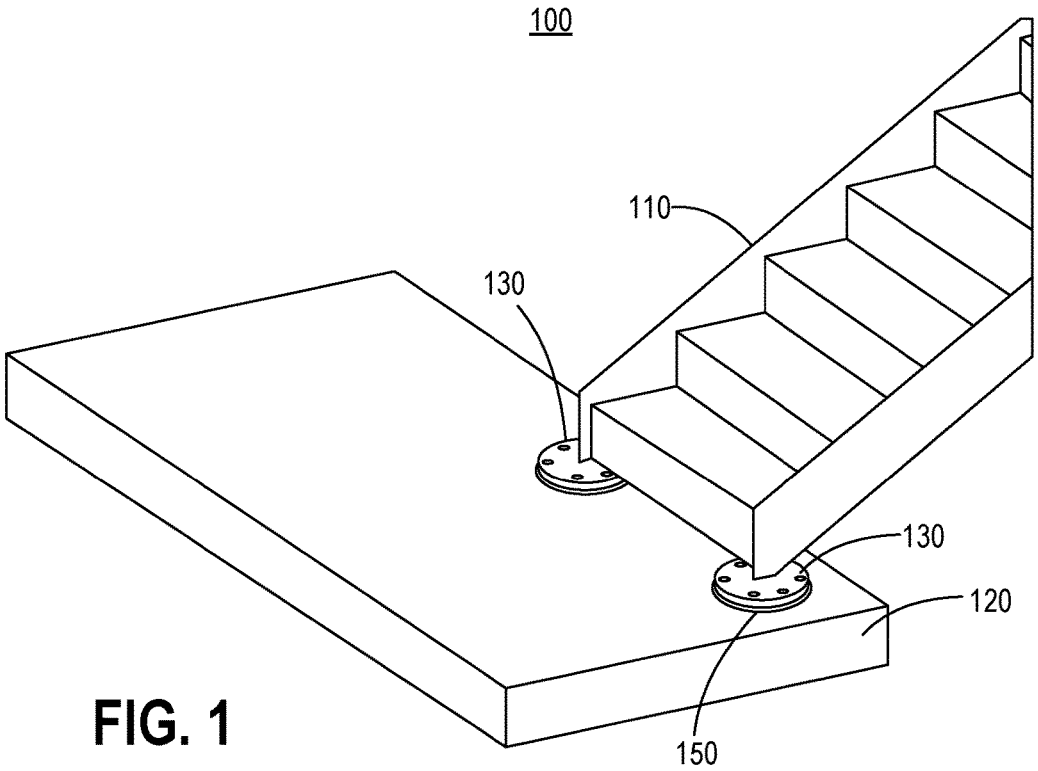
FIG. 1 is a perspective diagram of a base isolated stair system in an exemplary embodiment.

In various exemplary embodiments, a stair expansion joint system with freedom of movement between levels is described. In particular, the present disclosure describes a top landing-based stair expansion joint system and method which enables freedom of movement between the stairs and the landing, providing safe egress such as during earthquakes or other building failure scenarios. Again, the top landing-based stair expansion joint system addresses a common failure location. The top landing-based stair expansion joint system uses a sliding hinge connection between the stairs and the top landing, enabling horizontal and vertical movement between the two for inter-story drift while concurrently maintaining structural integrity.

Additionally, various additional types configurations are also described for the stair expansion joint system to provide functioning connection points of the stair system allowing for movement between levels (inter-story drift) while concurrently maintaining structural integrity. These various stair expansion joint system designs allow for independent movement of the surrounding building walls, landings, floor slabs, or any portion of the surrounding building structure to the stair system(s). The designs include components to cover or fill the open space between stairs (expansion joint covers) and surrounding structure. Inclusive is a secondary device(s) capable of maintaining consistent spacing within the expansion joint spaces as well the ability to return the stairs near to its original location. The stair expansion joint system could as well be part of the mounting structure for securing the stairs to landings, surrounding building structures, or floor slabs.

The stair expansion joint system can be utilized in applications for new construction as well be used in the field of existing constructions for retrofit applications for the seismic movement between levels, landings or within the stairwell structure. The stair expansion joint system can include either metal and/or polymer materials or combination of by extruding shapes or through secondary manufacturing process. The stair expansion joint system can be partial or fully assembled in house or in the field. Providing such system(s) allow for differential movements between levels and within the stair well structure to reduce or eliminate damage during building movement whether it be from wind, thermal, seismic or combination. The stair expansion joint system allows for directional movement or combination of, tension and compression, lateral, or vertical movement.

In an exemplary embodiment, a stair system with freedom of movement between landings associated therewith includes a connection system configured to connect stairs to a landing associated with a construction, wherein the connection system structurally supports the stairs for safe egress over the stairs while concurrently supporting movement between the landing and a second landing associated with the construction by the stairs in at least one dimension, and wherein the movement supports inter-story drift between the landing and the second landing and removes some force translation between the landing and the second landing.

Optionally, the landing is a lower landing and the second landing is an upper landing. The stair system can further include a second connection system configured to connect the stairs to the second landing, wherein the second connection system structurally supports the stairs for safe egress over the stairs while concurrently supporting movement between the landing and the second landing associated with the construction by the stairs in at least one dimension. Alternatively, the landing is an upper landing and the second landing is a lower landing.

Figure 2:
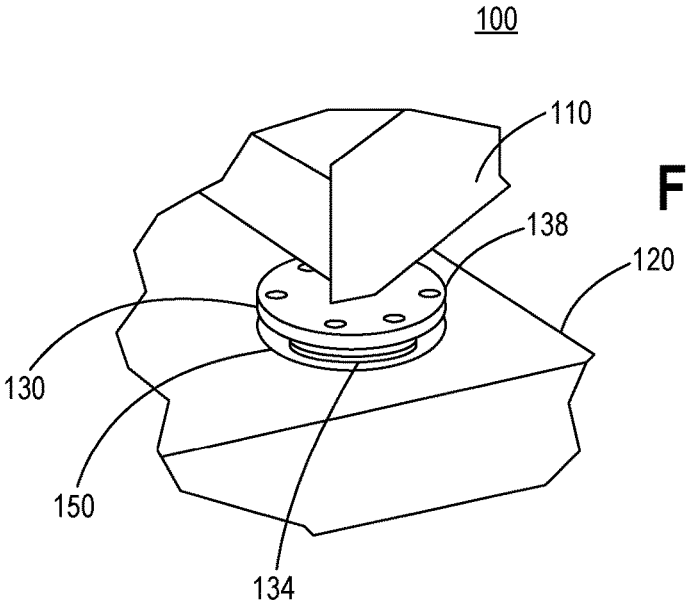
FIG. 2 is a magnified perspective diagram of the base isolated stair system of FIG. 1 illustrated a base isolator between stairs and a lower landing in an exemplary embodiment.
Figure 4:
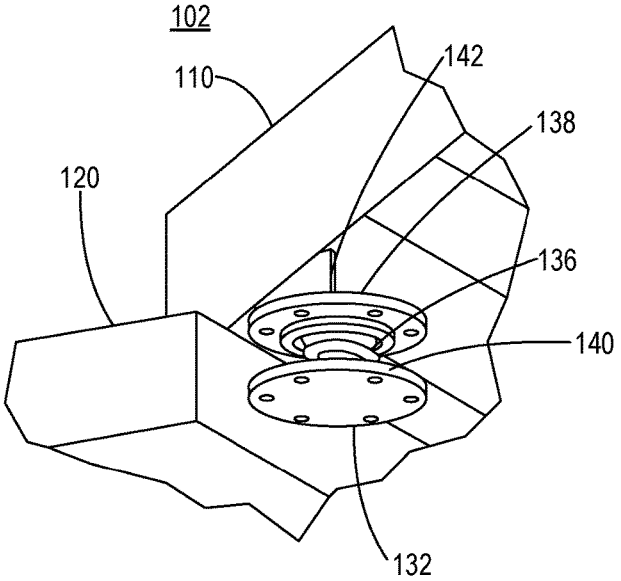
FIG. 4 is a magnified perspective diagram of the spring damper base isolated stair system of FIG. 3 illustrated a base isolator between stairs and a lower landing in an exemplary embodiment.
Figure 3:
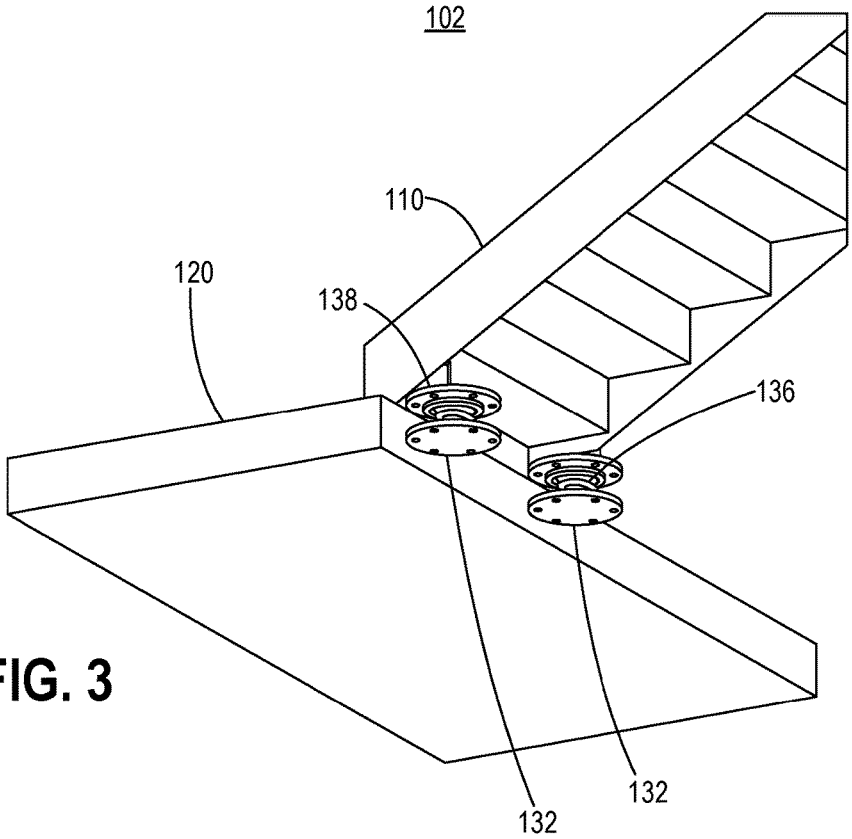
FIG. 3 is perspective diagram of a spring damper base isolated stair system in an exemplary embodiment.

Referring to FIGS. 1-4, in exemplary embodiments, perspective diagrams illustrate a stair system 100, 102. Specifically, the stair system 100, in FIGS. 1 and 2, is a base isolated system, and the stair system 102, in FIGS. 3 and 4, is a spring damper, base isolated system. The stair systems 100, 102 include stairs 110, including treads, risers, railings, etc., that are configured for multi-dimensional movement with a lower landing 120. That is, the stairs 110 are not fixedly attached to the lower landing 120. The stair systems 100, 102 include a base isolator 130, 132 between the stairs 110 and the lower landing 120. The base isolators 130, 132 utilize a similar design, with the base isolator 130 utilizing rubber isolators 134 and the base isolator 132 utilizing an isolator spring 136.

The base isolator 130, 132, illustrated in FIGS. 3 and 4 with the lower landing 120 cut away, include two bearing pads 138, 140 that are moveably attached to one another via the rubber isolators 134 for the base isolator 130 or via the isolator spring 136 for the base isolator 132. The bearing pads 138, 140 are illustrated in a circular structure, but other embodiments for the structure are contemplated. The bearing pad 138 is connected to the stairs 110. For the stair system 100, in FIG. 2, the bearing pad 138 is connected to a bottom of the stairs 110. For the stair system 102, in FIG. 3, the bearing pad 138 is connected to the stairs 110 via an angle mount 142. Of course, the stair system 102 can connect to the bottom of the stairs and the stair system 100 can use the angle mount 142. Other attachment mechanisms are also contemplated.

The base isolator 130, illustrated in FIGS. 1 and 2, is disposed within a well 150 in the lower landing 120. The well 150 is dimensioned and sized to receive the base isolator 130, 132. With the well 150, the base isolator 130, 132 can be fixedly connected to the lower landing 120, but movably disposed allowed for multi-dimensional movement of the stairs 110 relative to the lower landing 120. That is, the rubber isolators 134 and the isolator spring 136 enable Z-axis movement, and the well 150 enables movement in the X-Y plane. Thus, the force translated between the lower landing 120 and an upper landing (not shown) is minimized. Note, while the base isolators 130, 132 are illustrated disposed in the lower landing 120, the base isolators 130, 132 can also be connected at the upper landing.

With the stair systems 100, 102, the connection system includes at least two of the base isolators 130, 132 connected to the stairs 110 and supported by the landing 120, wherein each of the at least two base isolators 130, 132 include a first bearing pad connected to the stairs, a second bearing pad support by the landing, and a flexible member between the first bearing pad and the second bearing pad. Optionally, the flexible member is an isolator spring or a rubber isolator, and wherein the at least two base isolators provide movement of the stairs in multiple dimensions relative to the landing.

Figure 6:
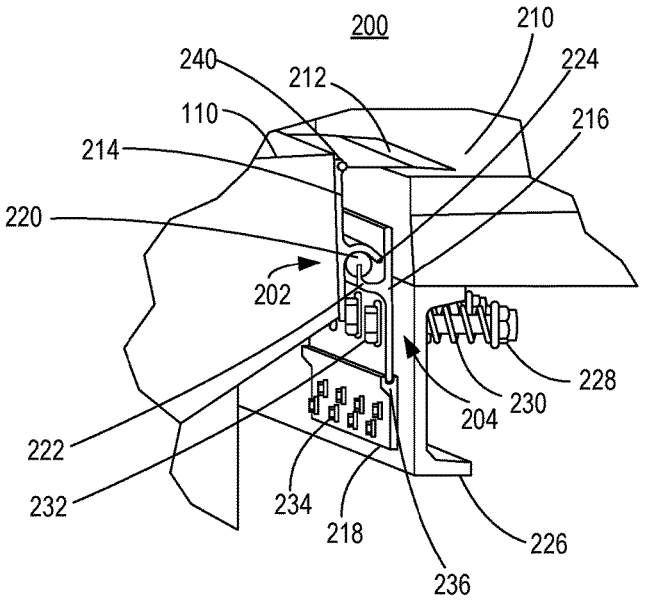
FIG. 6 is a magnified perspective diagram of a lateral slide joint for the hinged lateral slide stair system of FIG. 5 in an exemplary embodiment.
Figure 5:
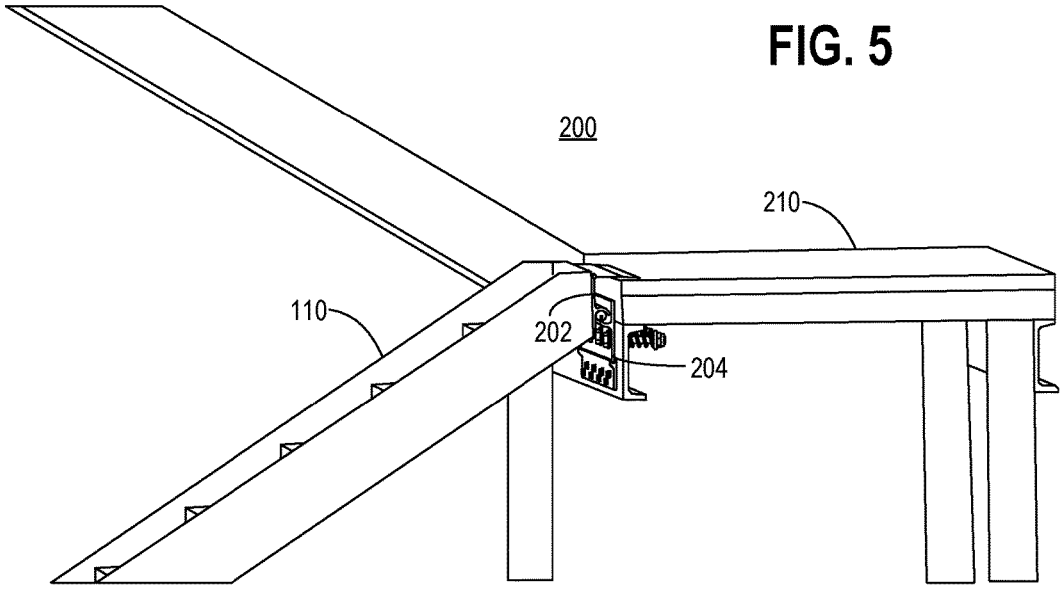
FIG. 5 is a perspective diagram of a hinged lateral slide stair system in an exemplary embodiment, illustrating a latch associated with stairs and a catch associated with an upper landing.
Figure 7:
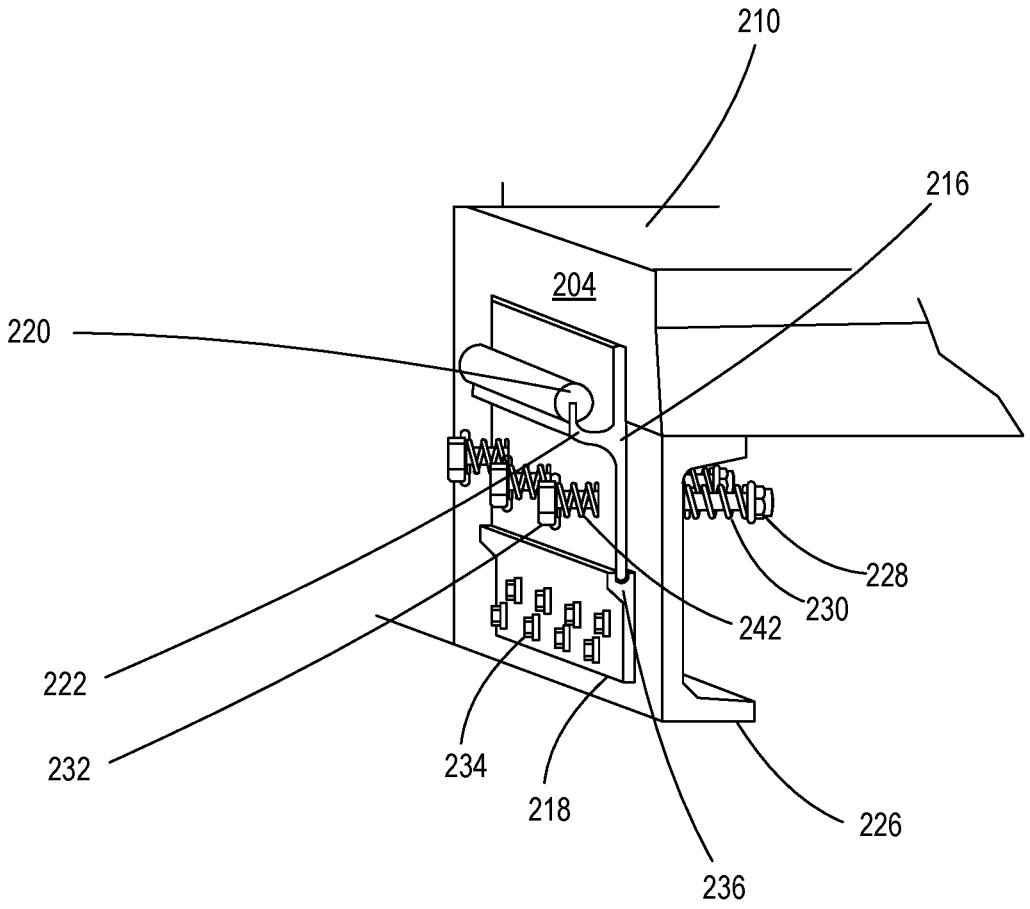
FIG. 7 is a magnified perspective diagram of the catch of the hinged lateral slide stair system in FIGS. 5-6 illustrating various associated components.
Figure 8:
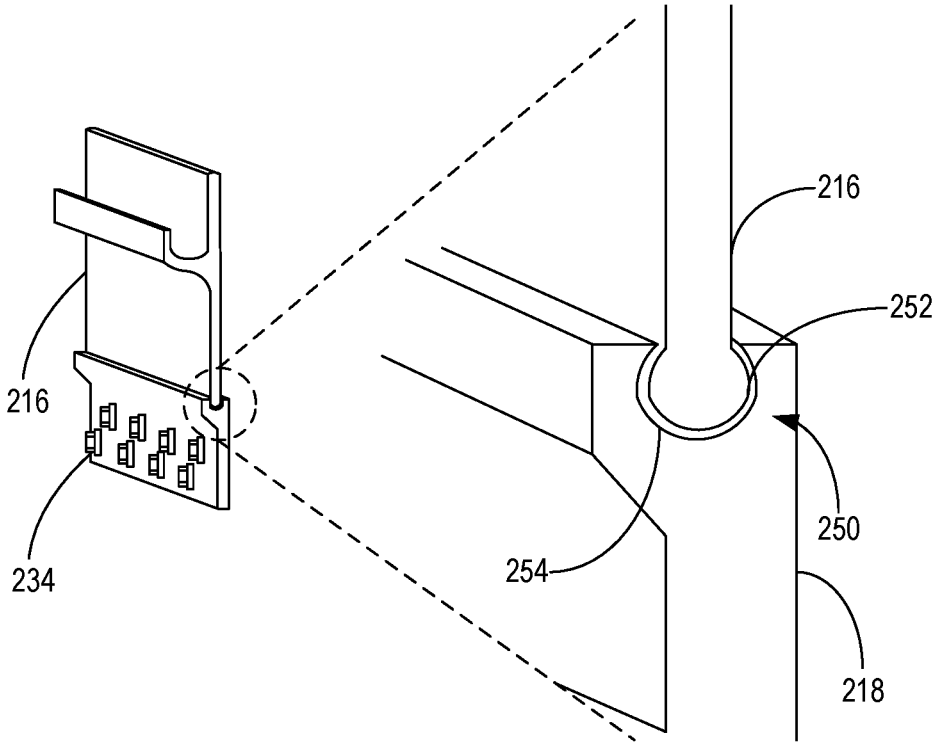
FIG. 8 is a magnified perspective diagram of the catch of the hinged lateral slide stair system in FIGS. 5-6 and associated connectivity to the upper landing.

Referring to FIGS. 5,6, 7, and 8, in an exemplary embodiment, perspective diagrams illustrate a hinged lateral slide stair system 200. The hinged lateral slide stair system 200 is a top landing-based stair expansion joint system and includes a latch system 202 associated with the stairs 110 and a catch system 204 associated with an upper landing 210. FIG. 5 is a perspective diagram of the hinged lateral slide stair system 200 in an exemplary embodiment, illustrating the latch system 202 associated with the stairs 110 and the catch system 204 associated with the upper landing 210. FIG. 6 is a magnified perspective diagram of the hinged lateral slide stair system 200 an exemplary embodiment illustrating various associated components of the latch system 202 and the catch system 204. FIG. 7 is a magnified perspective diagram of the catch system 204 illustrating various associated components, and FIG. 8 is a magnified perspective diagram of the catch system 204 connectivity to the upper landing 210.

The hinged lateral slide stair system 200 keeps the stairs 110 from being rigidly anchored to an upper landing 210, allowing for horizontal and/or lateral movement relative to the upper landing 210. The stairs 110, at the lower landing 120 (not shown in FIGS. 5 and 6) can be connected via any of the systems described herein or fixedly attached. The hinged lateral slide stair system 200 includes a landing plate 212, a stair mount 214, a lateral slide 216, and a base mount 218. The landing plate 212 can be hinged to the stair mount 214 and/or the stairs 110. The landing plate 212 is laid over the upper landing 210 to cover a gap between the stairs 110 and the upper landing 210 based on the construction of the hinged lateral slide stair system 200.

The stair mount 214 is connected to the stairs 110 and is configured to connect the stairs to the lateral slide 216 via a connector or rod 220. For example, the stair mount 214 can be bolted to the stairs 110, integrally formed with the stairs 110, etc. In this exemplary embodiment, the connector or rod 220 is a cylindrical structure that can be formed of suitable materials such as high-density polyethylene (HDPE) or the like. In an exemplary embodiment, the rod 220 is a Delrin® slide rod (e.g., an acetal homopolymer resin). Alternatively, the rod 220 could be other materials such as aluminum, steel, or the like. The material for the rod 220 can be based on associated point loads. The connector or rod 220 is fixedly or slidingly connected to a flange structure 222 connected to or integrally formed in the lateral slide 216. For example, the flange structure 222 can hook into the rod 220. The stair mount 214 includes a lip structure 224 that is placed over the connector or the rod 220. Collectively, the connector or rod 220, the flange structure 222, and the lip structure 224 enable lateral and/or horizontal movement of the stairs 110 relative to the upper landing 210. The lip structure 224 can be secured over the connector to ensure the stairs 110 do not detach from the upper landing 210. The lip structure 224 can be connected to the stair mount 214 or integrally formed therewith.

The lateral slide 216 is not fixedly attached to the upper landing 210. Specifically, the lateral slide 216 can be connected to a structure or beam 226, such as an I-beam, a beam, or the like, associated with the upper landing 210 with bolts 228 and springs 230. The bolts 228 can be connected to the structure or beam 226 via nuts 232, and the springs 230 enable movement of the bolts 228 and the lateral slide 216. The base mount 218 is fixedly attached to the structure or beam 226, such as via bolts 234. The base mount 218 includes a lip structure 236 which provides support for the lateral slide 216 in a vertical, Z-axis, orientation. The base mount 218 can be a steel plate or the like that is load bearing.

With the hinged lateral slide stair system 200, the connection system includes a hinged lateral slide mechanism between the stairs and the landing, the landing is an upper landing, wherein the hinged lateral slide mechanism prevents the stairs from rigid attachment to the upper landing. The hinged lateral slide mechanism can include a stair mount on the stairs coupled to a lateral slide on the upper landing via a connector; and a base mount fixed to the upper landing or an associated structure, wherein the base mount supports the lateral slide, and wherein the lateral slide is moveable relative to the upper landing or the associated structure and the stair mount is moveable relative to the lateral slide via the connector.

The latch system 202 includes the landing plate 212, the stair mount 214, and the lip structure 224. The catch system 204 includes the lateral slide 216, the base mount 218, the rod 220, the bolts 228, the springs 230, and the lip structure 236. The latch system 202 mounts to the stairs 110 and the catch system 204 mounts to the upper landing 210, such as to the beam 226. Once the components, i.e., the latch system 202 and the catch system 204, are connected, the stairs 110 rest or "latch" into the catch system 204.

The landing plate 212 is an expansion joint cover that ensures no gaps between the stairs 110 and the upper landing 210 if and when there is movement between the stairs 110 and the upper landing 210. Again, the landing plate 212 can connect to the stair mount 214 via a hinge 240, allowing the landing plate 212 to rotate relative to the stairs 110 to provide access to the latch 202 system and the catch system 204. The landing plate 212 can include a bevel to increase its strength. Also, the landing plate 212 can have various slopes and shapes as required for access between the stairs 110 and the upper landing 210.

The hinged lateral slide stair system 200 allows the stairs to move laterally (left or right) on the rod 220. The spring components (the bolts 228, the springs 230, and the nuts 232) pull the stairs 110 back against the upper landing 210 and the beam 226 in the event the stairs 110 pull away from the upper landing 210. Specifically, the lateral slide 216 is connected to or integrally formed in the beam 226 or the upper landing 210. The lateral slide 216 is attached to the beam 226 or the upper landing 210 by the spring components.

FIG. 7 illustrates the catch system 204 without the latch system 202 and the stairs 110. Also, in another exemplary embodiment, the bolts 228 can also extend out between the catch system 204 and the latch system 202, with an additional spring 242. In another exemplary embodiment, the springs 230 can be omitted, in place of the spring 242.

Again, the catch system 204 via the lateral slide 216 is connected to the beam 226 or the upper landing 210 via the spring components. FIG. 8 illustrates a hinge connection 250 between the lateral slide 216 and the base mount 218. The spring components allow the lateral slide 216 and thus the catch system 204 to move relative to the beam 226 or the upper landing 210. The hinge connection 250 illustrates vertical support for the lateral slide 216. Specifically, the base mount 218 is fixedly connected to the beam 226 or the upper landing 210, such as via the bolts 234. The lateral slide 216 includes a bulged portion 252 along a bottom side of the lateral slide 216. The bulged portion 252 is adapted to slide through a channel 254 in the base mount 218. The channel 254 is adapted to hold the bulged portion 252 in place, thereby supporting the lateral slide 216. Of note, the hinged lateral slide stair system 200 describes a stair expansion joint system enabling freedom of movement between the stairs 110 and the upper landing 210. That is, the hinged lateral slide stair system 200 provides freedom of movement at a joint at the upper landing 210. In various exemplary embodiments, the hinged lateral slide stair system 200 can be used in conjunction with other systems 100, 102, 300, 400, 500, 600, 700 described herein which detail connectivity between the stairs 110 and the lower landing 120. That is, the top connectivity freedom of movement of the hinged lateral slide stair system 200 contemplates use with the other systems 100, 102, 300, 400, 500, 600, 700 which provide freedom of movement between the stairs 110 and the lower landing 120.

In an exemplary embodiment, a stair expansion joint system 200 enabling freedom of movement between stairs and an upper landing includes the latch system 202 associated with the stairs 110; and a catch system 204 associated with a upper landing 210, wherein the catch system 204 includes a rod 220 adapted to connect to the latch system 202 and one or more spring components 228, 230, 232 adapted to connect the catch system 204 to the upper landing 210, the rod 220 connected to the latch system 202 and the one or more spring components 228, 230, 232 connected to the upper landing 210 collectively provide the freedom of movement between the stairs 110 and the upper landing 210.

The latch system 202 includes a landing plate 212 and a stair mount 214 including a lip structure 224 adapted to engage the rod 220, and wherein the catch system 204 includes a lateral slide 216 connected to a base mount 218, wherein the rod 220 is disposed to a flange structure 222 on the lateral slide 216 and the one or more spring components 228, 230, 232 connect the lateral slide 216 to the upper landing 210. The landing plate 212 is connected to the stair mount 214 via a hinge 240 enabling the landing plate 212 to rotate about the stair mount 214, providing access to the latch system 202 and the catch system 204 from the upper landing 210. The base mount 218 is fixed to a beam 226 associated with the upper landing 210 and the lateral slide 216 is connected to the beam 226 via the one or more spring components 228, 230, 232. The lateral slide 216 slidingly engages a channel 254 in the base mount 218. The stair mount 214 is one of connected to and integrally formed in a top of the stairs 110. The rod 220 can include an acetal homopolymer resin.

In another exemplary embodiment, a stair expansion joint method enabling freedom of movement between stairs and an upper landing includes providing a latch system 202 associated with the stairs 110; and providing a catch system 204 associated with the upper landing 210, wherein the catch system 204 includes a rod 220 adapted to connect to the latch system 202 and one or more spring components 228, 230, 232 adapted to connect the catch system 204 to the upper landing 210, the rod 220 connected to the latch system 202 and the one or more spring components 228, 230, 232 connected to the upper landing 210 collectively provide the freedom of movement between the stairs 110 and the upper landing 210.

In a further exemplary embodiment, a stair system with freedom of movement between the stairs and associated landings includes stairs 110 including a latch system 202 at a top of the stairs 110, wherein the latch system 202 includes a landing plate 212 and a stair mount 214 including a lip structure 224 adapted to engage the rod 220; and a structure 236 associated with an upper landing 210 including a catch system 204, wherein the catch system 204 includes a lateral slide 216 connected to a base mount 218, wherein a rod 220 is disposed to a flange structure 222 on the lateral slide 216 and one or more spring components 228, 230, 232 connect the lateral slide 216 to the upper landing 210, wherein the rod 220 connected to the latch system 202 and the one or more spring components 228, 230, 232 connected to the structure 236 collectively provide the freedom of movement between the stairs 110 and the upper landing 210.

Figure 9:
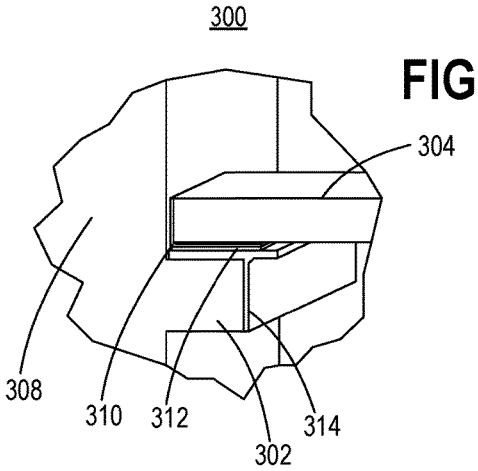
FIG. 9 is a side perspective diagram of a precast stair slide system in an exemplary embodiment.
Figure 10:
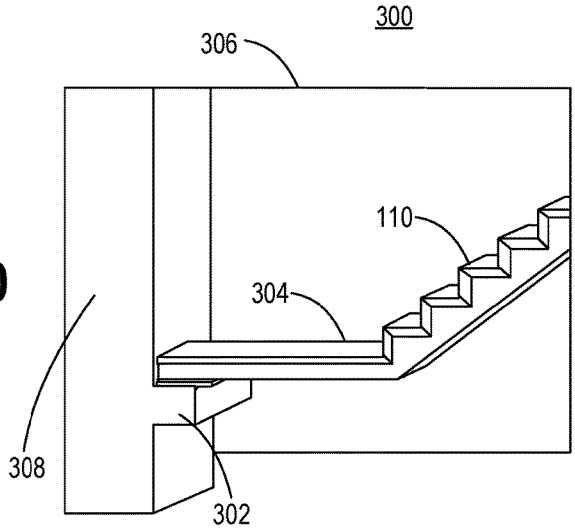
FIG. 10 is a magnified perspective diagram of the precast stair slide system of FIG. 9 illustrating bearings on a landing structure in an exemplary embodiment.
Figure 11:
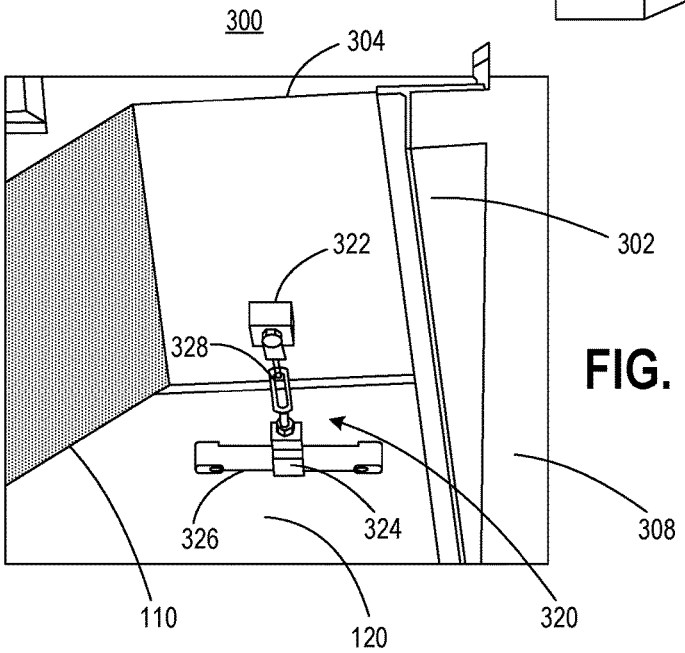
FIG. 11 is a perspective view underneath the precast stair slide system of FIG. 9 in an exemplary embodiment.

Referring to FIGS. 9, 10, and 11, in an exemplary embodiment, perspective diagrams illustrate a precast stair slide system 300. FIG. 9 is a side perspective diagram of the precast stair slide system 300, FIG. 10 is a magnified perspective diagram of the precast stair slide system 300 illustrating bearings on a landing structure 302, and FIG. 11 is a perspective view underneath the precast stair slide system 300. The precast stair slide system 300 include the stairs 110 integrally formed with a landing portion 304. The landing portion 304 is located next to the lower landing 120 as shown in FIG. 11, and optionally next to a wall 306. The precast stair slide system 300, through the stairs 110, can be fixedly attached to the upper landing (not shown in FIGS. 9, 10, and 11).

The landing portion 304 is moveably supported by the landing structure 302, which is formed or connected to a fixed structure 308. The landing structure 302 extends from the fixed structure 308 to provide support for the landing portion 304. The precast stair slide system 300 includes a stair bearing pad 310, a high-density polyethylene bearing pad 312, and a landing structure bearing pad 314. The stair bearing pad 310 is between the landing portion 304 and the fixed structure 308 and between the landing portion 304 and the high-density polyethylene bearing pad 312. The landing structure bearing pad 314 is between the landing structure 302 and the high-density polyethylene bearing pad 312.

In FIG. 11, the precast stair slide system 300 includes a precast stair separator assembly 320 which is configured to moveably connect the precast stair slide system 300 to the lower landing 120. The precast stair slide system 300 is configured to float relative to the lower landing 120 based on the precast stair separator assembly 320. The precast stair separator assembly 320 includes a fixed connection 322 underneath the landing portion 304 and a moveable connector 324 connected to a fixed connection 326 underneath the lower landing 120. The moveable connector 324 is connected to the fixed connection 322 via a tether 328.

With the precast stair slide system 300, the connection system includes a precast stair slide system supported by a structure associated with the landing; and a tether system configured to connect a landing portion of the precast stair slide system to the landing in a moveable manner. The precast stair slide system can further include a plurality of bearing pads between the landing portion and the structure associated with the landing.

Figure 13:
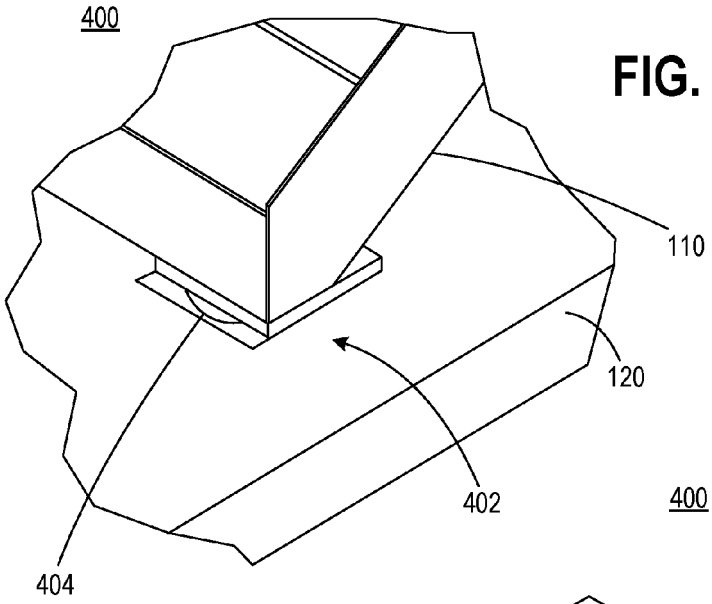
FIG. 13 is a magnified perspective diagram of a roller isolated assembly in the roller isolated stair system of FIG. 12.
Figure 12:
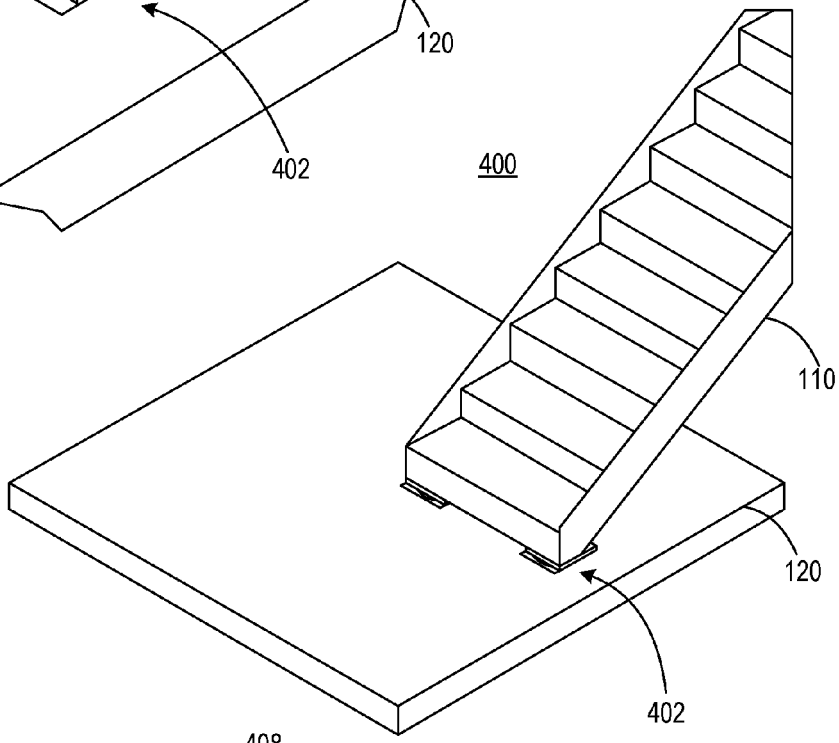
FIG. 12 is a perspective diagram of a roller isolated stair system in an exemplary embodiment.
Figure 14:
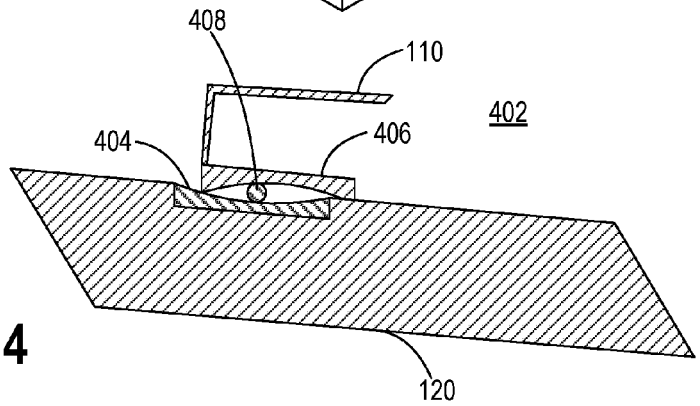
FIG. 14 is a cross-sectional diagram of the roller isolated assembly of FIG. 13 in an exemplary embodiment.

Referring to FIGS. 12, 13, and 14, in an exemplary embodiment, perspective diagrams illustrate a roller isolated stair system 400. FIG. 12 is a perspective diagram of the roller isolated stair system 400, FIG. 13 is a magnified perspective diagram of a roller isolated assembly 402, and FIG. 14 is a cross-sectional diagram of the roller isolated assembly 402. The roller isolated stair system 400 enables horizontal and vertical movement by the stairs 110 relative to the lower landing 120. Specifically, the roller isolated assembly 402 includes a ball bearing base surface 404 partially cast into the lower landing 120. The stairs 110 include a ball bearing support surface 406. A ball bearing 408 is included between the ball bearing base surface 404 and the ball bearing support surface 406. In this manner, the stairs 110 support movement based on engagement between the ball bearing support surface 406 and the ball bearing base surface 404 via the ball bearing 408.

With the roller isolated stair system 400, the connection system includes a roller isolated assembly with a ball bearing base surface connected to the landing, a ball bearing support surface connected to the stairs, and a ball bearing between the ball bearing base surface and the ball bearing support surface, wherein the stairs are moveable relative to the landing about the ball bearing.

Referring to FIGS. 15 and 16, in an exemplary embodiment, perspective diagrams illustrate a sliding base stair system 500. FIG. 15 is a perspective diagram of the sliding base stair system 500, and FIG. 16 is a magnified perspective diagram of a sliding base assembly 502 in the sliding base stair system 500. The sliding base assembly 502 includes a high-density polyethylene plate 504 coupled to the lower landing 120 and a high-density polyethylene plate 506 disposed to the stairs 110. A metal plate 508 is disposed between the high-density polyethylene plate 504 and the high-density polyethylene plate 506. Accordingly, the stairs 110 support horizontal and/or vertical movement relative to the lower landing 120.

With the sliding base stair system 500, the connection system includes a sliding base assembly with a first plate connected to the stairs, a second plate connected to the landing, and a third plate between the first plate and the second plate, wherein the stairs are moveable relative to the landing based on the third plate. The first plate and the second plate can be high-density polyethylene and the third plate can be metal.

Figure 17:
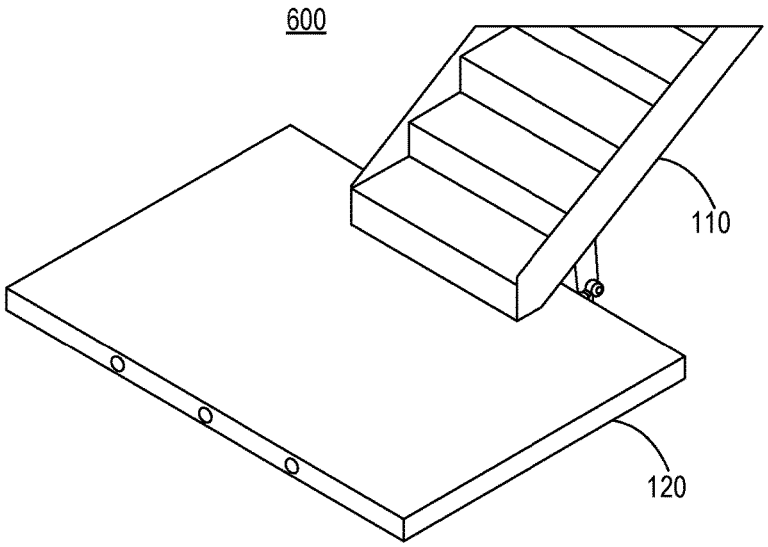
FIG. 17 is a perspective diagram of a stair pin system in an exemplary embodiment.
Figure 18:
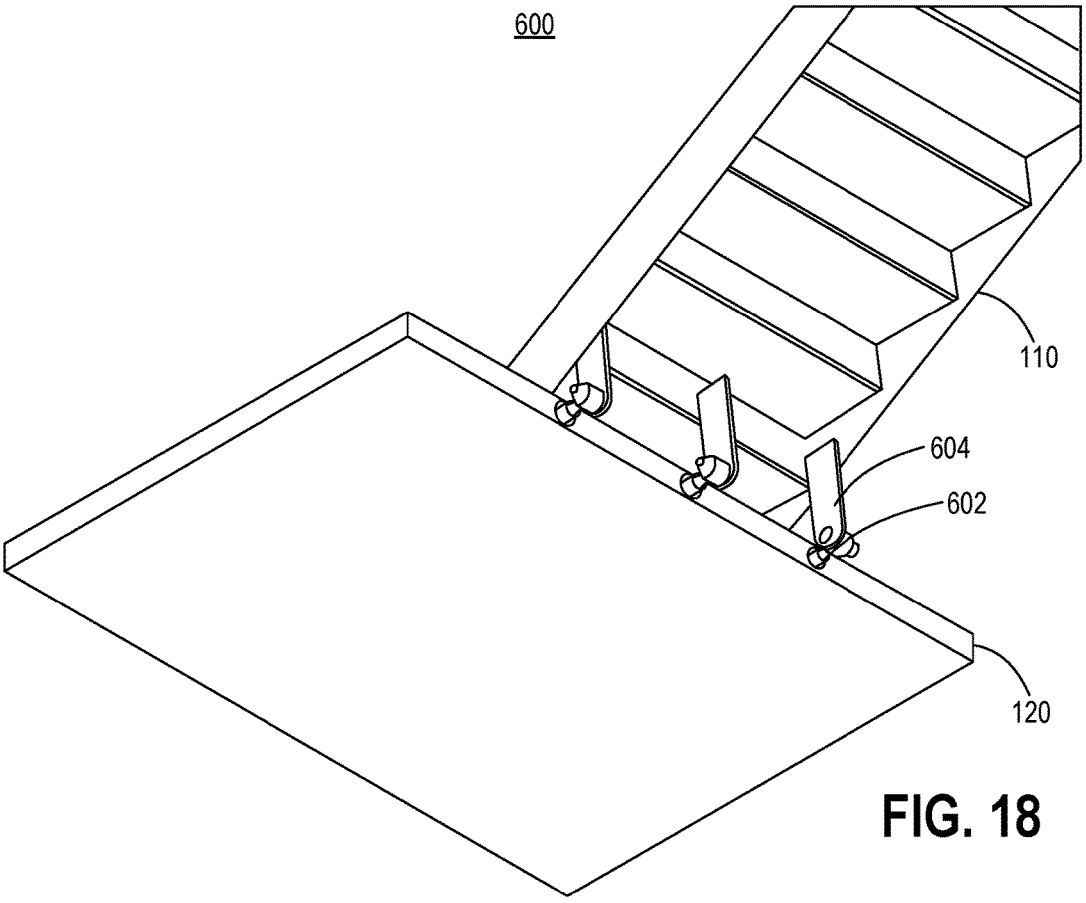
FIG. 18 is a perspective diagram underneath the stair pin system of FIG. 16 in an exemplary embodiment.

Referring to FIGS. 17 and 18, in an exemplary embodiment, perspective diagrams illustrate a stair pin system 600. FIG. 17 is a perspective diagram of the stair pin system 600, and FIG. 16 is a perspective diagram underneath the stair pin system 600. The stair pin system 600 includes pistons 602 disposed in the lower landing 120 and attached to under the stairs 110 via arms 604. The pistons 602 are configured to movement in and out of the lower landing 120 providing one-dimensional movement between the stairs 110 and the lower landing 120.

With the stair pin system 600, the connection system includes a stair pin system with a plurality of pistons connected to the landing and connected to the stairs via arms, wherein the stairs are moveable in one dimension based on movement of the pistons.

Figure 20:
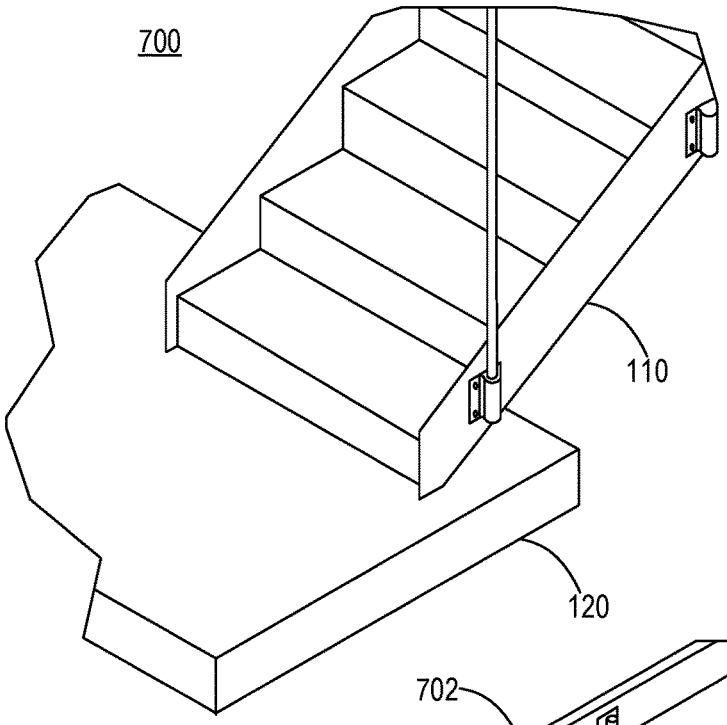
FIG. 20 is a magnified perspective diagram of the stairs and lower landing in the suspended stair system of FIG. 19 in an exemplary embodiment.
Figure 19:
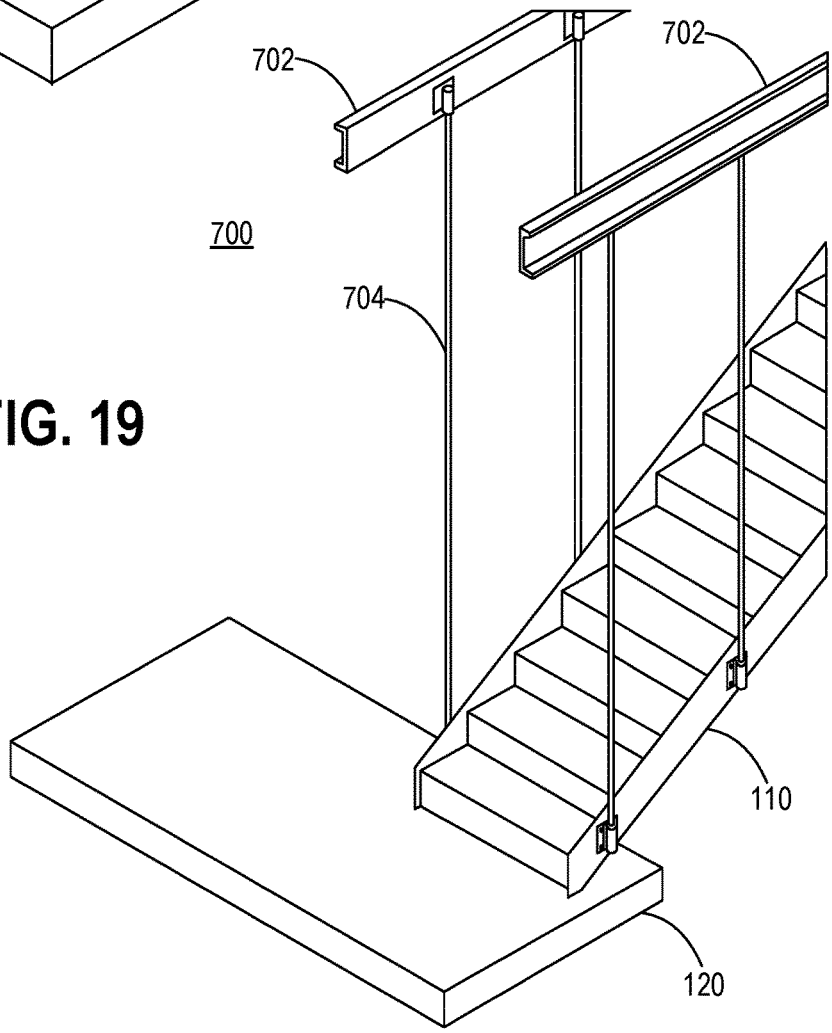
FIG. 19 is a perspective diagram of a suspended stair system in an exemplary embodiment.

Referring to FIGS. 19 and 20, in an exemplary embodiment, perspective diagrams illustrate a suspended stair system 700. FIG. 19 is a perspective diagram of the suspended stair system 700, and FIG. 20 is a magnified perspective diagram of the stairs 110 and lower landing 120 in the suspended stair system 700. The suspended stair system 700 is a hanging configuration where the stairs 110 are not fixedly attached to the lower landing 120. This takes the rigidity out of the stairs 110. The suspended stair system 700 includes fixed structural members 702 that are part of a construction, such as part of a floor associated with an upper landing (not shown). The stairs 110 are supported by tethers 704 that are fixedly attached to the fixed structural members 702 and the stairs 110.

With the suspended stair system 700, the connection system includes a suspended stair assembly with attachments to a structure associated with the landing, the landing is an upper landing, and tethers to the stairs from the attachments, wherein the stairs are not fixedly attached to a lower landing.

The various systems 100, 102, 200, 300, 400, 500, 600, 700 include a stair expansion joint system with freedom of movement between the landings 120, 210. The systems 100, 102, 200, 300, 400, 500, 600, 700 provide functioning connection points of between the stairs 110 and the lower landing 120 and/or the upper landing 210 allowing for movement between the landings 120, 210 (inter-story drift) while concurrently maintaining structural integrity of an associated construction (the landings 120, 210, the stairs 110, etc.). These various systems 100, 102, 200, 300, 400, 500, 600, 700 allow for independent movement of the surrounding building walls, landings, floor slabs, or any portion of the surrounding building structure to the various systems 100, 102, 200, 300, 400, 500, 600, 700. The designs include components to cover or fill the open space between the stairs 110 (expansion joint covers) and surrounding structures, the landings 120, 210. Inclusive is a secondary device(s) capable of maintaining consistent spacing within the expansion joint spaces as well the ability to return the stairs near to its original location. The systems 100, 200, 300, 400, 500, 600, 700 could as well be part of the mounting structure for securing the stairs 110 to landings 120, 210, surrounding building structures, or floor slabs.

The systems 100, 102, 200, 300, 400, 500, 600, 700 can be utilized in applications for new construction as well be used in the field of existing constructions for retrofit applications for the seismic movement between levels, landings or within the stairwell structure. The systems 100, 102, 200, 300, 400, 500, 600, 700 can include either metal and/or polymer materials or combination of by extruding shapes or through secondary manufacturing process. The systems 100, 102, 200, 300, 400, 500, 600, 700 can be partial or fully assembled in house or in the field. Providing such systems 100, 102, 200, 300, 400, 500, 600, 700 allow for differential movements between levels and within the stair well structure to reduce or eliminate damage during building movement whether it be from wind, thermal, seismic or combination. The systems 100, 102, 200, 300, 400, 500, 600, 700 allow for directional movement or combination of, tension and compression, lateral, or vertical movement.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A stair expansion joint system enabling freedom of movement between stairs and a landing, the stair expansion joint system comprising:

a latch system associated with the stairs; and a catch system associated with the landing, wherein the catch system comprises a rod adapted to connect to the latch system and one or more spring components adapted to connect the catch system to the landing, the rod connected to the latch system and the one or more spring components connected to the landing collectively provide the freedom of movement between the stairs and the landing;

wherein the latch system comprises a landing plate and a stair mount comprising a lip structure adapted to engage the rod, and wherein the catch system comprises a lateral slide connected to a base mount, wherein the rod is disposed to a flange structure on the lateral slide and the one or more spring components connect the lateral slide to the landing.

2. The stair expansion joint system of claim 1, wherein the landing plate is connected to the stair mount via a hinge enabling the landing plate to rotate about the stair mount, providing access to the latch system and the catch system from the landing.

3. The stair expansion joint system of claim 1, wherein the base mount is fixed to a beam associated with the landing and the lateral slide is connected to the beam via the one or more spring components.

4. The stair expansion joint system of claim 3, wherein the lateral slide slidingly engages a channel in the base mount.

5. The stair expansion joint system of claim 1, wherein the stair mount is one of connected to and integrally formed in a top of the stairs.

6. The stair expansion joint system of claim 1, wherein the rod comprises an acetal homopolymer resin.

7. A stair expansion joint method enabling freedom of movement between stairs and a landing, the stair expansion joint method comprising:

providing a latch system associated with the stairs; and providing a catch system associated with the landing, wherein the catch system comprises a rod adapted to connect to the latch system and one or more spring components adapted to connect the catch system to the landing, the rod connected to the latch system and the one or more spring components connected to the landing collectively provide the freedom of movement between the stairs and the landing;

wherein the latch system comprises a landing plate and a stair mount comprising a lip structure adapted to engage the rod, and wherein the catch system comprises a lateral slide connected to a base mount, wherein the rod is disposed to a flange structure on the lateral slide and the one or more spring components connect the lateral slide to the landing.

8. The stair expansion joint method of claim 7, wherein the landing plate is connected to the stair mount via a hinge enabling the landing plate to rotate about the stair mount, providing access to the latch system and the catch system from the landing.

9. The stair expansion joint method of claim 7, wherein the base mount is fixed to a beam associated with the landing and the lateral slide is connected to the beam via the one or more spring components.

10. The stair expansion joint method of claim 9, wherein the lateral slide slidingly engages a channel in the base mount.

11. The stair expansion joint method of claim 7, wherein the stair mount is one of connected to and integrally formed in a top of the stairs.

12. The stair expansion joint method of claim 7, wherein the rod comprises an acetal homopolymer resin.

13. A stair system with freedom of movement between the stairs and associated landings, the stair system comprising:

stairs comprising a latch system at a top of the stairs, wherein the latch system comprises a landing plate and a stair mount comprising a lip structure adapted to engage a rod; and a structure associated with a landing comprising a catch system, wherein the catch system comprises a lateral slide connected to a base mount, wherein a rod is disposed to a flange structure on the lateral slide and one or more spring components connect the lateral slide to the landing, wherein the rod connected to the latch system and the one or more spring components connected to the landing collectively provide the freedom of movement between the stairs and the structure.

14. The stair system of claim 13, wherein the landing plate is connected to the stair mount via a hinge enabling the landing plate to rotate about the stair mount, providing access to the latch system and the catch system from the landing.

15. The stair system of claim 13, wherein the base mount is fixed to a beam associated with the landing and the lateral slide is connected to the beam via the one or more spring components.

16. The stair system of claim 13, wherein the stair mount is one of connected to and integrally formed in a top of the stairs.

17. The stair system of claim 13, wherein the rod comprises an acetal homopolymer resin.

18. The stair system of claim 13, wherein the landing comprises an upper landing and further comprising:

a connection system between a bottom of the stairs and a lower landing.

* * * * *